US008292420B2

(12) United States Patent
Weingartner et al.

(10) Patent No.: US 8,292,420 B2
(45) Date of Patent: Oct. 23, 2012

(54) LOCATING DEVICE FOR AN INKJET PRINTER

(75) Inventors: Peter Weingartner, Dölsach (AT); Thomas Guggenberger, Oberdrauburg (AT)

(73) Assignee: Durst Phototechnik Digital Technology GmbH, Lienz (AT)

( * ) Notice: Subject to any disclaimer, the term of this patent is extended or adjusted under 35 U.S.C. 154(b) by 662 days.

(21) Appl. No.: 11/920,947

(22) PCT Filed: May 24, 2006

(86) PCT No.: PCT/AT2006/000213

§ 371 (c)(1),
(2), (4) Date: Jul. 31, 2008

(87) PCT Pub. No.: WO2006/125239

PCT Pub. Date: Nov. 30, 2006

(65) Prior Publication Data

US 2009/0295895 A1 Dec. 3, 2009

(51) Int. Cl.
*B41J 2/01* (2006.01)

(52) U.S. Cl. ..... 347/104

(58) Field of Classification Search ..... 347/16, 347/104

See application file for complete search history.

(56) References Cited

U.S. PATENT DOCUMENTS

| | | | | |
|---|---|---|---|---|
| 5,171,006 | A * | 12/1992 | Naito | 271/9.09 |
| 6,270,215 | B1 | 8/2001 | Miyasaka et al. | |
| 6,350,029 | B1 * | 2/2002 | Szlucha et al. | 347/104 |
| 6,582,072 | B1 | 6/2003 | Wotton et al. | |

FOREIGN PATENT DOCUMENTS

| | | |
|---|---|---|
| DE | 199 01 994 | 7/1999 |
| EP | 1 022 147 | 7/2000 |
| EP | 1 060 897 | 12/2000 |
| JP | 11-157285 | 6/1999 |

OTHER PUBLICATIONS

International Search Report, Aug. 24, 2006
English Translation of International Preliminary Report on Patentability (IPRP).

* cited by examiner

*Primary Examiner* — Stephen Meier
*Assistant Examiner* — Tracey McMillion
(74) *Attorney, Agent, or Firm* — Collard & Roe, P.C.

(57) ABSTRACT

The invention describes an inkjet printer (1) for printing different media (2), with a print head arrangement (3) comprising at least one print head (4) for printing the medium (2) and with a printing table (11) forming a support plane (12) for supporting the printing medium (2), and orifices (13) of a suction system (14) are provided in at least certain regions in the support plane (12) for retaining the printing medium (2) during the printing operation, as well as a forward feed mechanism (6) for the printing medium (2). In the region of the printing table (11), the printing medium (2) is provided with at least one pressing mechanism (16), at least in the region of a side edge oriented in the forward feed direction (7), with a pressing force which acts in the direction perpendicular to the support plane (12).

22 Claims, 5 Drawing Sheets

LOCATING DEVICE FOR AN INKJET PRINTER

CROSS REFERENCE TO RELATED APPLICATIONS

This application is the National Stage of PCT/AT2006/000213 filed on May 24, 2006 which claims priority under 35 U.S.C. §119 of Austrian Application No. A 895/2005 filed on May 25, 2005. The international application under PCT article 21(2) was not published in English.

The invention relates to an inkjet printer for printing different media, with a print head arrangement comprising at least one print head for printing the medium and a printing table forming a support plane for supporting the printing medium, and orifices of a suction system are provided in at least certain regions in the support plane for retaining the printing medium during the printing operation, as well as a forward feed mechanism for the printing medium, and the forward feed mechanism is provided in the form of at least one endlessly circulating conveyor belt, and in the region of the printing table, the printing medium is provided with at least one pressing mechanism in the region of a side edge oriented in the forward feed direction, with a pressing force acting in the direction perpendicular to the support plane.

Patent specification U.S. Pat. No. 6,582,072 B1 discloses a printer for printing media, with a print head arrangement comprising at least one print head for printing the medium. The forward feed mechanism is provided in the form of an endlessly circulating conveyor belt. A printing table forms a support surface for supporting the printing medium and orifices of a suction system open into the support plane in order to retain the printing medium. Disposed in the region of the print head is a printing zone disposed transversely to the forward feed direction. Upstream of this in the forward feed direction is a retaining zone. A pressing roller for the printing medium is also provided in the region of the retaining zone, which co-operates with the circulating conveyor belt to apply the printing medium against the conveyor belt and subsequently against the printing table with a pre-definable pressing force. Instead of the pressing roller, a stationary, smooth and curved pressing and guide element may be provided for the printing medium, at least in the region of a side edge oriented in the forward feed direction. It is likewise disposed in the retaining zone.

Patent specification JP 11-157285 A discloses a printer for printing media, with a print head arrangement comprising at least one print head for printing the medium. This printer has a printing table, forming a support plane which supports the printing medium. Orifices of a suction system open into this support plane, which are provided as a means of retaining the printing medium during the printing operation. In order to convey the printing medium, a drive shaft is provided underneath the support plane, on the two ends of which drive rollers are mounted. They co-operate with pressing rollers, which co-operate with side edges of the printing medium oriented in the forward feed direction and cause the driving movement of the medium. Friction wheels are also mounted on the drive shaft between the drive rollers. Due to the suction on the printing medium in the region of the support plane, the printing medium additionally lies on the friction wheels, which assists the driving movement for the printing medium.

Patent specification EP 1 022 147 A discloses a medium conveying system for conveying a sheet of a specific medium in a marker device. The media conveying system comprises a feed-in drive unit and a discharge drive unit. The feed-in drive unit receives and conveys the sheet in the processing direction due to contact with the top and reverse face of the sheet. The feed-in drive unit applies a feed-in driving force to the sheet. The discharge drive unit receives and conveys the sheet due to contact with the top and reverse face of the sheet. The discharge drive unit is spaced at a distance apart from the feed-in drive unit and applies a discharge driving force to the sheet. Disposed between the feed-in drive unit and the discharge drive unit is a stationary plate serving as a printing table, which is provided with orifices and passages for creating a vacuum. The media conveying system also has edge guides extending in the processing direction along the stationary plate. The edge guides receive, guide and hold the edge of the sheet flat. The forward feed movement of the printing medium is produced by feed-in drive rollers disposed in the feed-in region and discharge drive rollers disposed in the discharge region.

Patent specification EP 1 060 897 A describes a printer for printing media, with a print head arrangement comprising at least one print head. Disposed underneath the print head is the printing table forming a support surface for the printing medium. Again, orifices of a suction system open into the support plane, which are provided as a means of retaining the printing medium during the printing operation. The forward feed mechanism is provided in the form of an endlessly circulating conveyor belt disposed between the printing table and the print head, which likewise has suction orifices. In a feed-in region of the printer, a pair of pressing rollers oriented transversely to the forward feed direction is provided upstream of the print head in the conveying feed direction. An inner pressing roller is disposed underneath the conveyor belt and an outer pressing roller is disposed above it. The printing medium is therefore fed between the pair of pressing rollers transversely to the forward feed direction across its entire width. An additional pressing roller is disposed downstream of the print head in the forward feed direction and co-operates with the drive roller for the conveyor belt.

In the cause of currently known inkjet printers, the printing medium is retained by suction through the orifices disposed in the support plane and the suction system communicating with it as a result. When printing sheet material of pre-definable sizes and applying the printed image by means of the inkjet print head arrangement, it is not always possible to prevent some warping of the printing medium in all applications.

The underlying objective of the invention is to provide a flat support for the printing medium in the support plane of the printing table.

This objective is achieved by the invention due to the fact that the pressing mechanism is disposed in at least a printing region of the print head arrangement and is essentially provided in the form of a flat section with flat faces and longitudinal side edges extending in between, and the pressing mechanism is retained respectively at its ends spaced apart from one another in the forward feed direction on a respective frame part of the printer disposed at a distance apart in the forward feed direction and oriented transversely to the forward feed direction, in particular perpendicular thereto, and disposed at a distance apart in the direction perpendicular to the support plane.

The surprising advantage obtained as a result of the features defined in the characterizing part of claim 29 resides in the fact that, in addition to the retaining mechanism provided in the form of the suction system, the printing medium is also provided with at least one pressing mechanism in the region of its side edges oriented in the forward feed direction, because these peripheral regions are also disposed flush with respect to the support plane precisely in the printing region and can be pressed against it. During the printing operation, therefore, the distance between the print head and the surface of the printing medium is always kept the same. As a result, a perfect print quality is always obtained of the printed image to be applied to the printing medium, including in these peripheral regions, without distortions or even blurring of the printed image occurring during the printing operation. Due to the pressing force applied to the printing medium by the pressing mechanism, it is not just the central surface of the printing medium that is placed on the printing table and forward feed mechanism, even in the case of stiffer media to be printed, such as paper or card of a heavier sheet weight, and instead the suction system is assisted due to the presence of the additional pressing mechanism. As a result, uninterrupted operation of the print head arrangement is guaranteed in its printing region. The pressing mechanism is kept stable by means of the frame parts on the base frame of the inkjet printer. As a result, use is made of virtually the entire longitudinal extension of the pressing mechanism for applying the pressing force to the printing medium. Due to the endlessly circulating conveyor belt, whilst the printing table remains stationary, the printing medium is able to effect a relative movement in the forward feed direction and the printing operation can proceed in steps in the printing regions or printing tracks disposed transversely to the forward feed direction.

Also of advantage is another embodiment defined in claim 30 because the pressing mechanism can be adapted to different dimensions of the printing medium, in particular its width, relatively easily without the need for lengthy manipulations.

Another embodiment defined in claim 31 is also of advantage because it rapidly enables allowance to be made for different sizes or thicknesses of the printing medium, and the gap between the support plane, in particular the printing table or forward feed mechanism and the pressing mechanism, through which the printing medium must necessarily be fed can be adjusted quickly and further fine adjustments can still be made, including as the operation proceeds.

As a result of the embodiment defined in claim 32, it is possible to position the printing medium perfectly at the two and achieve a flat orientation by reference to the support plane in the region of the surface to be printed.

The advantage of the embodiment defined in claim 33 is that a reference edge is disposed or provided and is stationary with respect to the inkjet printer, in particular its printing table, and the other pressing mechanism can therefore be positioned on the frame parts associated with it transversely to the forward feed direction and thus adjusted depending on the width of the printing medium.

As a result of another embodiment defined in claim 34, a rapid adjustment can be made transversely to the forward feed direction and generally also a simple adjustment to cater for different widths of the printing medium.

As a result of the embodiments defined in claims 35 to 37, even before the printing medium is introduced, its width can be detected and the guide width of the pressing mechanism can be rapidly and automatically adjusted to the width of the respective the printing medium. It is also possible to check the medium as it is being fed along, in order to ascertain the printing width of the printed image to be applied.

Also of advantage is an embodiment defined in claim 38 because the printed image can be applied to the medium virtually up to its side edges, and only a minimal strip is left behind in the area covered by the pressing mechanism to which no printed image can be applied. This results in a high degree of economy whilst producing a perfect printed image.

In one embodiment defined in claim 39 or claim 40, the printing medium is advantageously prevented from becoming jammed between the pressing mechanism and the printing table or forward feed mechanism and the printing medium is also guided longitudinally as it is fed through the inkjet printer.

In this respect, an embodiment as defined in claim 41 has proved to be of advantage because it enables a stable disposition of the pressing mechanism to be obtained relative to the printing table and forward feed mechanism whilst nevertheless providing a reliable and flat support for the printing medium.

Also of advantage is an embodiment defined in claims 42 to 46. In this case, an additional option is provided for a guide section or stiffening section, by means of which different sizes or thicknesses of printing medium can be printed with the inkjet printer. In this respect, thicknesses of up to 1 cm and more are possible, such as needed when printing thick card or corrugated cardboard. The flat section of the pressing mechanism is also made stiffer, which means that the printing medium can be perfectly oriented and hence positioned on the support plane along virtually the entire longitudinal extension of the pressing mechanism.

As defined in claim 47, in spite of the flat section having a slim thickness or depth, additional stiffness is imparted to the flat section to prevent flexing in the direction perpendicular to the support plane and a virtually uniform pressing force is applied to the printing medium across the longitudinal extension of the flat section.

As a result of the embodiment defined in claim 48, an effective support is provided to enable the pressing mechanism to be changed rapidly on the one hand, and on the other hand, when the support element is retained accordingly on the flat section, a relative, mutual displacement of these two components is possible. The support elements may be supported by interconnecting a displacement mechanism, in particular one or more retaining elements.

As a result of another embodiment defined in claim 49, the printing medium is fed perfectly into the pressing mechanism. The printing medium is roughly oriented in the inlet region and then introduced into and positioned in the guide passage in which the pressing force is simultaneously applied to the medium by the pressing mechanism.

Finally, yet another embodiment is defined in claim 50, whereby a flat support can also be provided for printing medium in the region of the printing table and printing is nevertheless able to take place across a bigger longitudinal range.

The invention will be explained in more detail below with reference to examples of embodiments illustrated in the appended drawings.

Of these:

Figure 1:
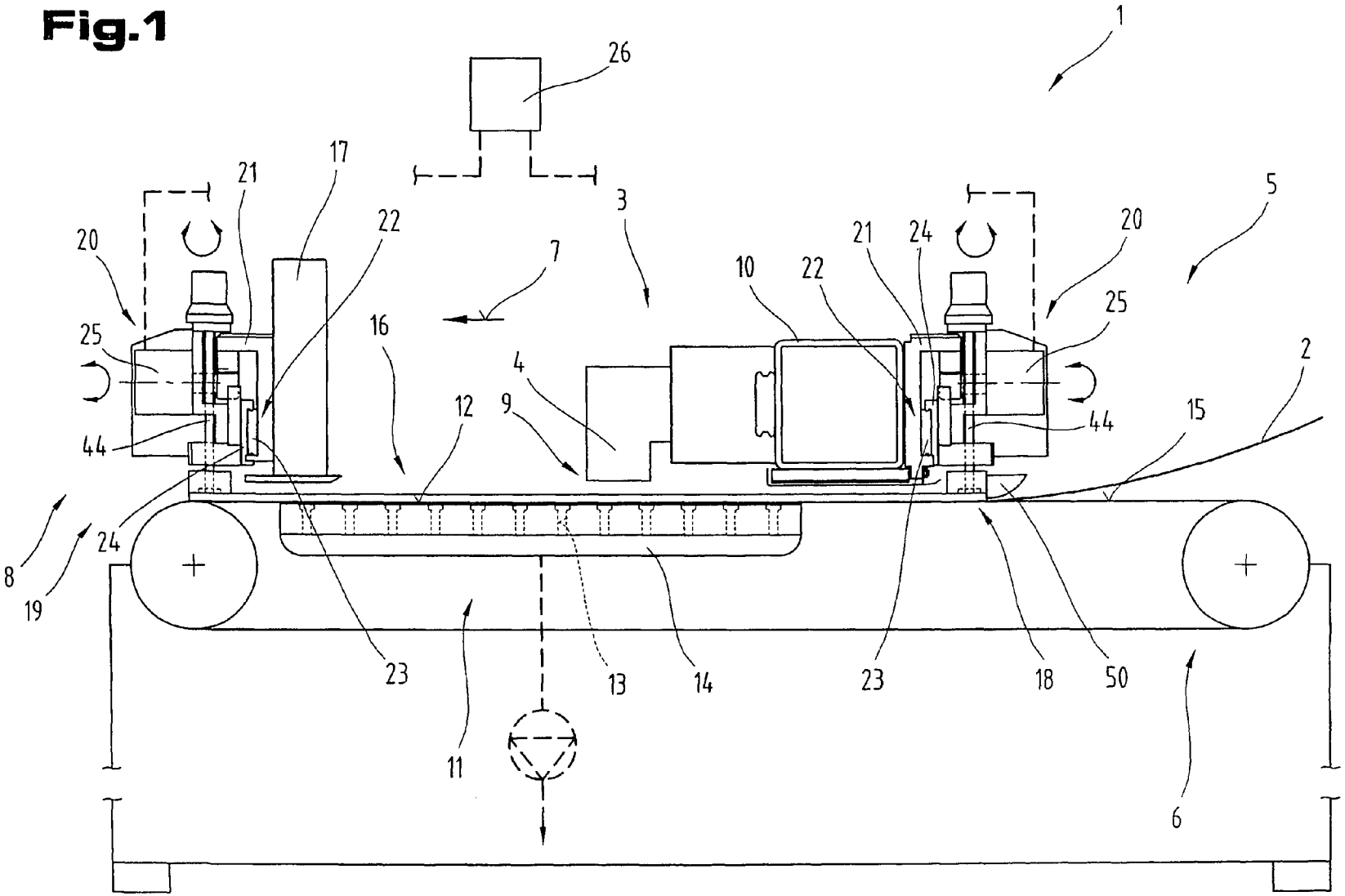
FIG. 1 is a simplified, schematic diagram showing a side view of an inkjet printer with a pressing mechanism proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIGS. 1 to 7 are highly simplified, schematic diagrams illustrating an inkjet printer 1 and its components for printing on different media 2. To this end, the inkjet printer 1 has at least one print head arrangement 3 with at least one print head 4 for printing the medium 2.

As illustrated on a schematically simplified basis in FIG. 1, the printing medium 2 is fed to the inkjet printer 1 from a feed-in region 5 and is conveyed onwards by means of a schematically illustrated forward feed mechanism 6 in the forward feed direction 7 or conveying direction—indicated by the arrow—to a discharge region 8. Disposed between the feed-in region 5 and the discharge region 8 is a printing region 9 formed by the print head arrangement 3, in particular the print head 4.

The print head arrangement 3 may be mounted or retained on a schematically illustrated frame part 10 of the inkjet printer 1, in a manner which has generally long been known from the prior art. A detailed description of this aspect will therefore not be given.

The inkjet printer 1 also has a printing table 11, which provides a flat support plane 12 for supporting the printing medium 2*t*. Orifices 13 of a suction system 14 also open into at least certain regions of the support plane 12, which are provided as a means of retaining the printing medium 2 during the printing operation. This operates by suction due to the differential pressure created.

In the embodiment illustrated as an example here, the forward feed mechanism 6 is provided in the form of at least one endlessly circulating conveyor belt 15. Irrespective of this, however, it would also be possible for the forward feed mechanism 6 to co-operate directly with the printing table 11 and move the medium 2 in the forward feed direction 7 past the print head arrangement 3 in a known manner together with the printing table during the printing operation.

If at least one or more conveyor belts 15 are used as the forward feed mechanism 6, appropriate orifices 13 or slots or similar are also provided in it or them, to enable the printing medium 2 to be sucked by the suction system 14 and hence onto the support plane 12. The lower pressure than the ambient atmospheric pressure may be generated by a schematically illustrated vacuum pump.

The suction system 14 described above in conjunction with the printing table 11 and optionally the conveyor belt 15 constituting the forward feed mechanism 6 ensure that the printing medium 2 delivered to the feed-in region 5 is sucked onto the forward feed mechanism 6 and printing table 11 and is thus held fixed during the printing operation to be carried out in the portion of the printing region 9 on the flat support plane 12 formed by the printing table 11 and forward feed mechanism 6.

Figure 2:
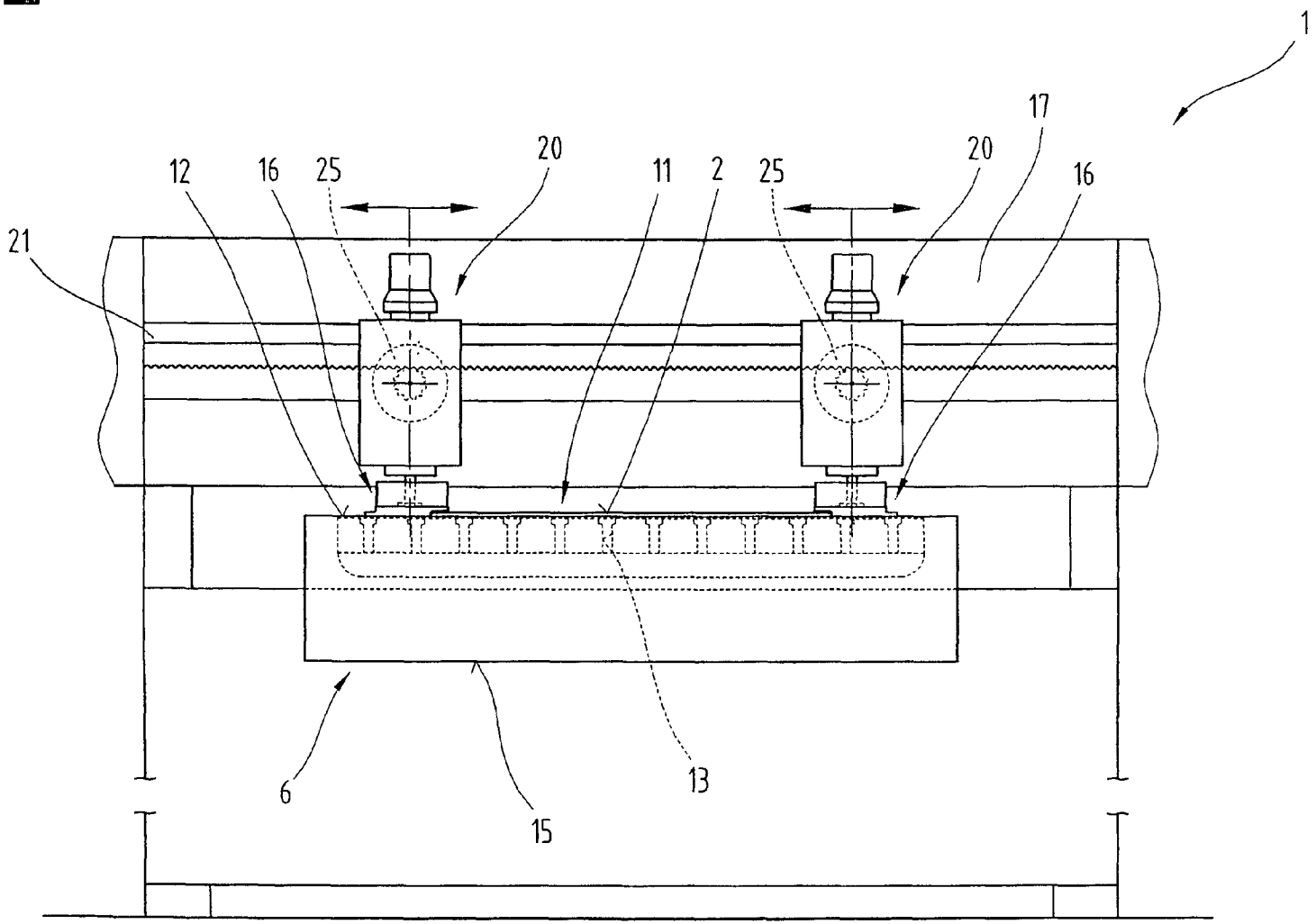
FIG. 2 is a simplified, schematic diagram showing a front view of the inkjet printer illustrated in FIG. 1.

As may be seen more clearly from FIG. 2, an additional pressing mechanism 16 is provided for the printing medium 2, in addition to the suction system 14, in the region of the printing table 11 at least in the region of a side edge oriented in the forward feed direction 7, which applies a pressing force to the printing medium 2 at the peripheral region of the medium 2, acting in the direction perpendicular to the support plane 12. The purpose of this pressing mechanism 16 is to improve warping or poor retention of the peripheral portion of the medium 2 on the support plane 12 so that a completely flat printing surface can also be obtained in the portion of the printing region 9 to be printed by the print head arrangement 3. If cut sheet material is used as the medium 2, for example, it has a tendency to warp to a certain extent in the peripheral region depending on how it is stored and due to its residual moisture content. If slightly stiffer material is used as the medium 2, the suction system 14 in conjunction with the orifices 13 is not usually enough to guarantee a totally flat support of the side edges of the medium 2 on the support plane 12 of the printing table 11 and forward feed mechanism 6 formed by the conveyor belt 15 in the peripheral region.

In order to adapt to different thicknesses of printing medium 2, the pressing mechanism 16 is designed and mounted so that it is able to move relative to the support plane 12 in a direction perpendicular to the support plane 12. The purpose of this movement is to provide a simple way of adapting or finely adjusting to differing thickness of the printing medium 2 quickly, in particular without involving extensive operations. Accordingly, this height adjustment relative to the support plane 12 may be carried out manually, for example by means of jack screws or similar, but may also be carried out automatically by means of displacement drives in conjunction with a control system of the inkjet printer 1, although this is not illustrated.

In order to adapt the pressing mechanism 16 or pressing mechanisms 16 to differing widths of the printing medium 2 transversely to the forward feed direction 7, at least one pressing mechanism 16 is provided in a direction perpendicular to the side edge of the medium 2 and parallel with the support plane 12, which is displaceable relative to the printing table 11. In this respect, it is preferable to provide a respective pressing mechanism 16 for each of the two side edges of the printing medium 2, which extends in the longitudinal direction, in other words in the forward feed direction 7, at least across the printing region 9 of the print head arrangement 3.

As briefly described above, the inkjet printer 1 has at least one frame part 10 respectively 17, which is illustrated on a simplified basis only, connected to a base frame or bed frame of the inkjet printer 1, which is merely indicated in the drawing and not shown by reference number. These frame parts 10, 17 are oriented transversely to, in particular perpendicular to, the forward feed direction 7. The print head arrangement 3 is retained or mounted on one of these frame parts 10, 17, and in the embodiment illustrated as an example here on the frame part 10, and can be displaced on it transversely to the forward feed direction 7 for performing the printing operation. The pressing mechanism 16 is also retained on at least one of these frame parts 10, 17 of the inkjet printer 1, and may optionally by mounted on it with interconnected retaining and displacement systems. However, the pressing mechanism 16 is preferably retained on one of the frame parts 10, 17 of the inkjet printer 1 disposed at a distance away in its longitudinal extension in the forward feed direction 7 and at a distance away in the direction perpendicular to the support plane 12. The two frame parts 10, 17 are therefore oriented transversely to, in particular perpendicular to, the forward feed direction 7 and, as viewed in the vertical direction, above the printing table 11, in particular the support plane 12, and are mounted on the base frame so as to be stationary, although they may also be displaceable if necessary.

In order to produce as long as possible a pressing area of the pressing mechanism 16, it is of advantage if the pressing mechanism 16 is mounted respectively at its ends 18, 19 spaced apart from one another in the forward feed direction 7 on a respective frame part 10, 17 of the inkjet printer 1 spaced apart in the forward feed direction 7 and oriented transversely to the forward feed direction 7, in particular perpendicular thereto, and at a distance from the support plane 12 in the vertical direction.

In the embodiment illustrated in FIG. 2, the two pressing mechanisms 16 are mounted on the frame part 10, 17 so that they can be moved transversely to, in particular perpendicular to, the forward feed direction 7 as indicated by the arrows. However, it would also be conceivable for one of the pressing mechanisms 16 to be mounted on the frame part 10, 17 so that it is stationary by reference to the forward feed direction 7 and the other pressing mechanism 16 is mounted on the frame part 10, 17 so that it can be moved transversely to the forward feed direction 7, in particular perpendicular thereto.

As may be seen more clearly from FIG. 1, it is of advantage if the pressing mechanism 16 is provided with at least one displacement mechanism 20 for effecting a displacement perpendicular to the side edge of the printing medium 2 and in the direction parallel with the support plane 12. This displacement mechanism 20 may be of various designs and in the case of the embodiment illustrated as an example here has at least one profiled section 21, which is of an angled design and is disposed or mounted on the frame parts 10, 17, preferably on the sides facing away from one another. In order to effect a longitudinal displacement in the direction of the frame parts 10, 17 disposed transversely to the forward feed direction 7, a guide arrangement 22 may also be provided in the form of a profiled track 23 for example, which is mounted in the profiled section 21. Engaging with this track 23 of the guide arrangement 22 is a guide carriage 24, by means of which the entire displacement mechanism 20 can be moved or displaced transversely to the forward feed direction 7 in the direction of the frame parts 10, 17. To make it easier to move and exactly position the pressing mechanism 16 by reference to the longitudinal side edges of the printing medium 2, it is of advantage if the pressing mechanism 16 is provided with at least one displacement mechanism 20 with a drive motor 25. The movement transversely to, in particular perpendicular to, the forward feed direction 7 can be produced by a positive drive connection, for example. This positive drive connection between the drive motor 25 and the stationary frame parts 10, 17, in particular the profiled section 21, may be configured on the basis of a rack and pinion connection. However, it would also be possible to use spindle drives or stepper motors or other driving connections such as friction wheel connections. If a separate displacement mechanism 20 is provided for each of the two ends 18, 19 of the pressing mechanism 16, a simultaneous parallel movement is effected.

The displacement mechanism 20, in particular the drive motor 25, may also be electrically connected to a schematically illustrated control unit 26. This being the case, it would be possible to pre-define a width of the printing medium 2 for the inkjet printer 1 via an input device, although this is not illustrated, and then move the displacement mechanism 20, in particular with the drive motor 25, via the control unit 26 so that the pressing mechanism 16 connected to the displacement mechanism 20 can be pre-set and adjusted to the width and hence the side edges of the printing medium 2. To enable the side edges of the printing medium 2 oriented in the forward feed direction 7 to be automatically detected, it would also be possible to provide at least one sensor in the feed-in region 5 of the printing table 11 oriented in the forward feed direction in order to detect a side edge the printing medium 2, in which case the sensor is electrically connected to the control unit 26. In order to retain clarity, a detailed illustration of the sensor has been omitted from the drawings. However, it might also be preferable to provide sensors for both of the side edges, by means of which the pressing mechanism 16 can be exactly oriented via the control unit 26, making allowance for the widths of the medium 2 as it is fed in.

When the medium 2 is being printed, the print head 4 of the inkjet printer 1 is guided along past the printing medium 2 at an exactly pre-definable distance from a printing plane on the medium 2. Since this distance between the printing plane of the printing medium 2 and the print head 4 is only relatively short, the pressing mechanism 16 may also extend by only a minimal degree across the printing plane formed by the printing medium 2 towards the side remote from the support plane 12. In the embodiment illustrated as an example, the pressing mechanism 16 is provided in the form of an essentially flat section 27 with flat faces 28, 29 and longitudinal side edges 30, 31 extending in between. The flat section 27 has an essentially rectangular cross-section, which has a width of 40 mm transversely to its longitudinal extension and a thickness of approximately 2 mm, for example.

In the region of the first longitudinal side edge 30, the flat section 27 has a pressing surface 32, offset from the flat face 29 directed towards the support plane 12, extending in the direction towards the oppositely lying flat face 28, which extends from the first longitudinal side edge 30 in the direction towards the other, oppositely lying longitudinal side edge 31. This pressing surface 32 may be offset from the flat face 29 directed towards the support plane 12 by an amount of 0.5 to 1 mm, for example. The pressing surface 32 extends from the first longitudinal side edge 30 across only a part-region of the width of the flat section 27 in the direction towards the other longitudinal side edge 31. This distance may be a quarter of the width of the flat section 27, for example.

Due to the fact that the pressing surface 32 is offset from the flat face 29 as described above, a transition region 33 is created between the pressing surface 32 and the face 29 of the flat section 27, which may also serve as an additional longitudinal guide portion 34 for the printing medium 2. In order to position the printing medium 2 exactly and provide a sufficient guiding effect for it in the forward feed direction 7 if necessary, the flat face 29 of the flat section 27 directed towards the support plane 12 is disposed directly adjacent to or adjoins it. The support plane 12 for the medium 2 may be formed either directly by the printing table 11 or the conveyor belt 15 of the forward feed mechanism 6.

On the longitudinal side edge 31 lying opposite the pressing surface 32, the flat section 27 may also have a web-type shoulder 35, the thickness 36 of which in the direction perpendicular to its longitudinal extension is slimmer than the thickness of the flat section 27 in the same spatial direction. The surface of the slimmer shoulder 35 is preferably flush with the flat face 29 directed towards the support plane 12. It would also be possible for the shoulder 35 to extend continuously along the longitudinal extension of the flat sections 27 or to be provided in certain regions only at pre-defined points.

This web-type shoulder 35 is used in situations where a thicker or deeper medium 2 has to be printed so that an additional angled section 37 can be held or placed on it, thereby imparting stiffness to the flat section 27 and also providing a longitudinal guiding action for the printing medium 2.

Figure 5:
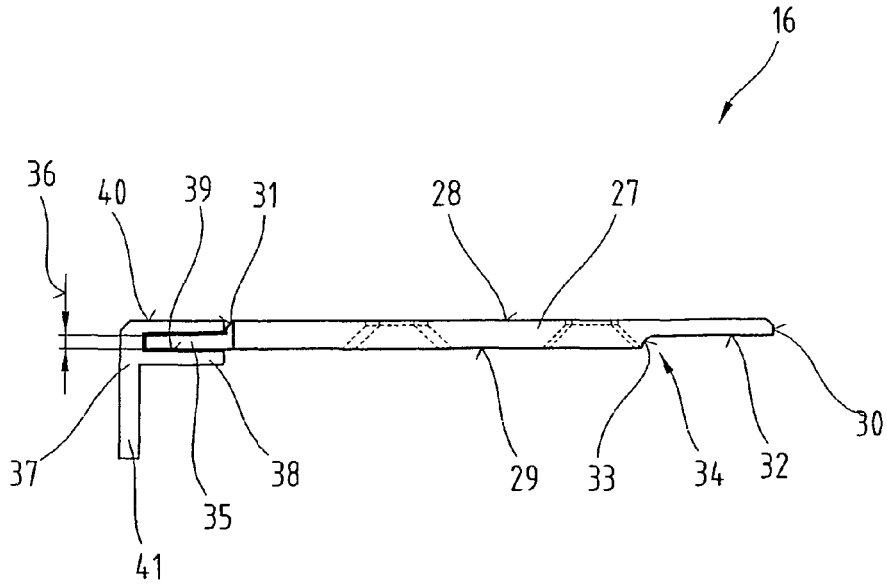
FIG. 5 is a front view of the flat section of the pressing mechanism illustrated in FIGS. 3 and 4 with an additional angled section.

As may be seen more clearly from FIG. 5, a first leg 38 of the angled section 37 has a groove-shaped recess 39 for accommodating the web-type shoulder 35. In order to obtain a slim thickness of the pressing mechanism 16 in the region of the additional angled section 37 in the region of the flat face 28 of the flat section 27 facing away from the support plane 12, a leg surface 40 of the first leg 38 of the angled section 37 is virtually flush with the flat face 28 of the flat section 27 on the side facing away from the support plane 12.

Another leg 41 of the angled section 37 extends in the direction towards the support surface 12. Due to the slim thickness of the flat section 27 in the direction perpendicular to the support plane 12, it also has a lower section modulus, preventing flexing in this direction. It is therefore of advantage if the pressing mechanism 16 formed by the flat section 27 is mounted so that it is tensed in its longitudinal extension between the frame parts 10, 17 disposed at a distance apart in the forward feed direction 7. This tensing imparts an artificial stiffening effect to the flat section 27, which means that in spite of the slim thickness of the flat section 27, sufficient pressing force can be applied to the side edges of the printing medium 2 in the longitudinal direction, thereby resulting in a totally flat support on the support plane 12.

Figure 3:
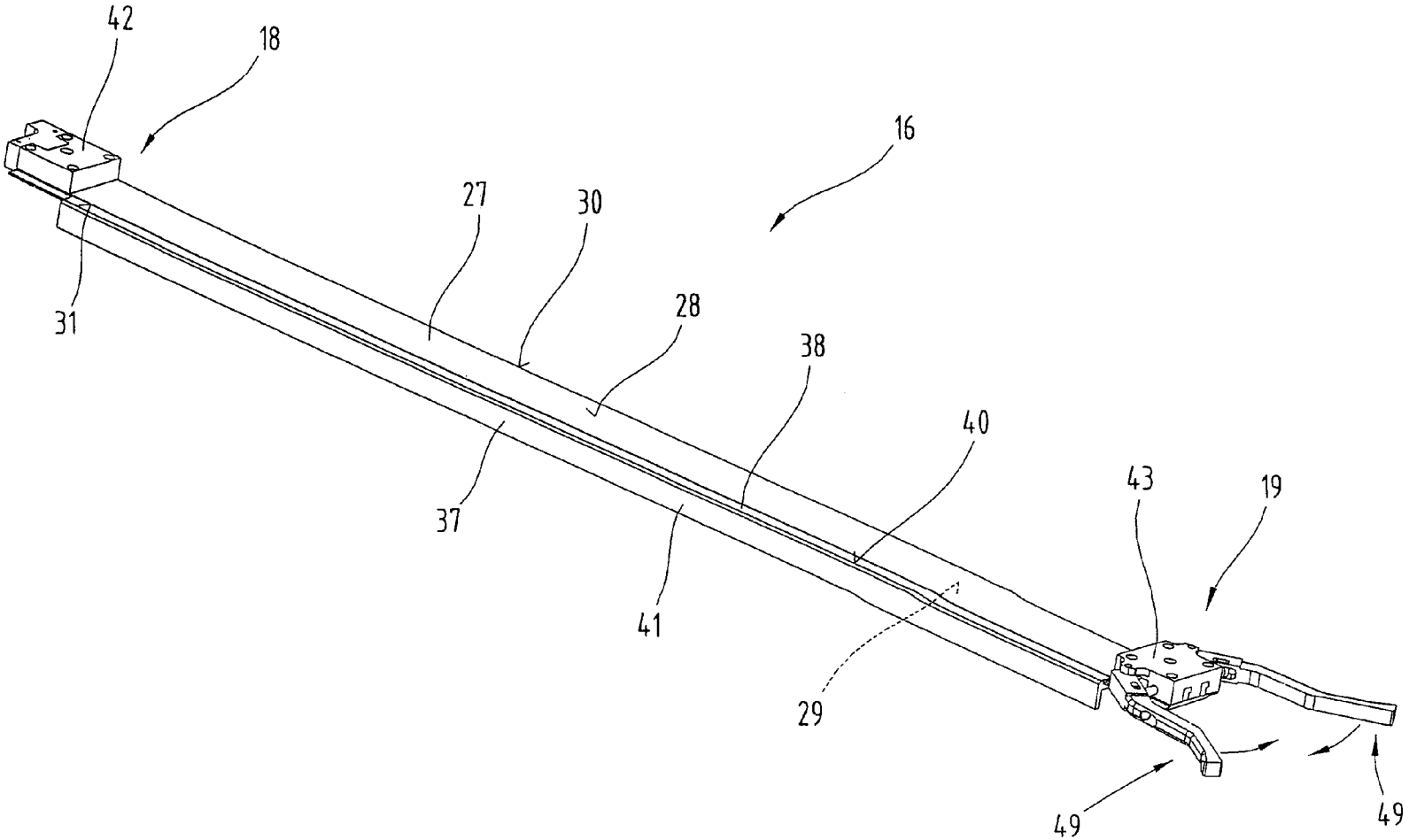
FIG. 3 is a simplified diagram illustrating an example of the pressing mechanism proposed by the invention.
Figure 4:
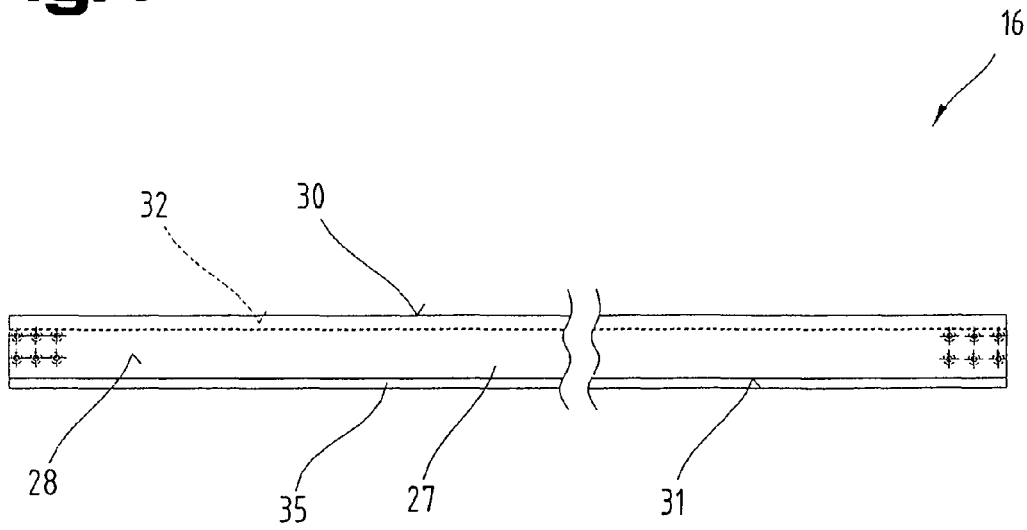
FIG. 4 is a plan view of the flat section of the pressing mechanism illustrated in FIG. 3.

As may best be seen from FIG. 3, a respective support element 42, 43 is provided on the flat section 27 at the mutually opposite ends 18, 19, which are each supported on the frame parts 10, 17 spaced at a distance apart from one another in the forward feed direction 7, optionally with the displacement mechanism 20 connected in between. This offers a simple way of making it easy to change the pressing mechanism 16 quickly.

Figure 6:
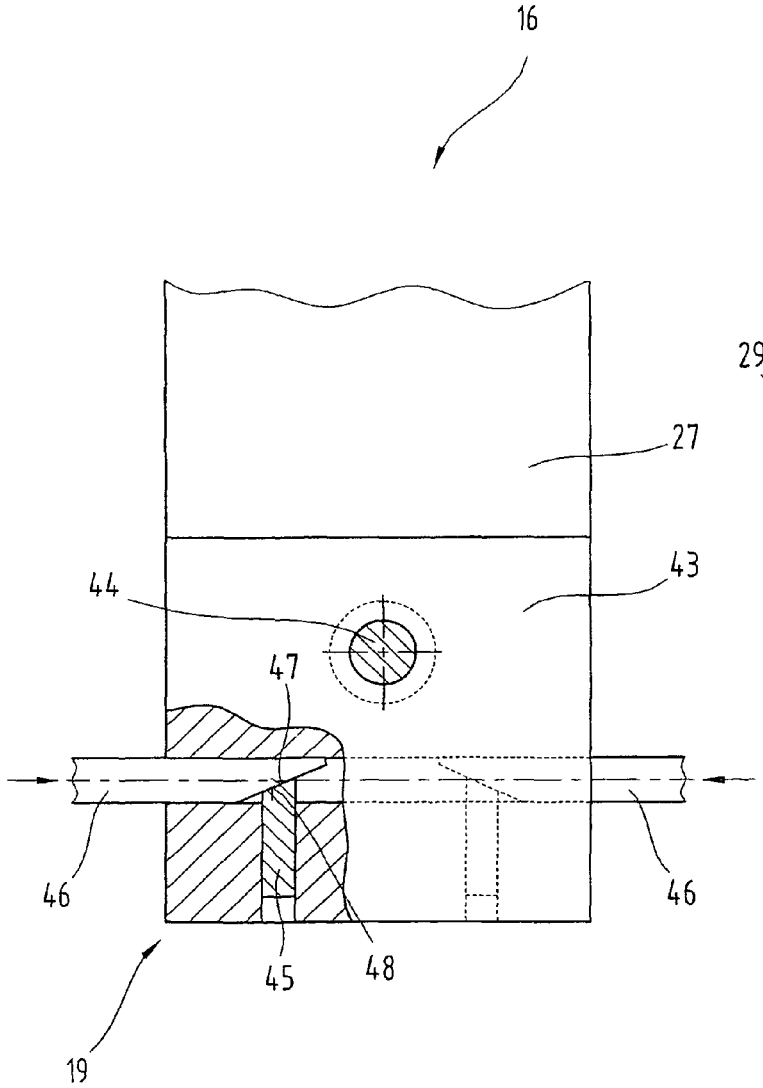
FIG. 6 is a simplified, schematic diagram in partial cross-section showing a plan view of one end of the pressing mechanism illustrated in FIGS. 3 to 5.
Figure 7:
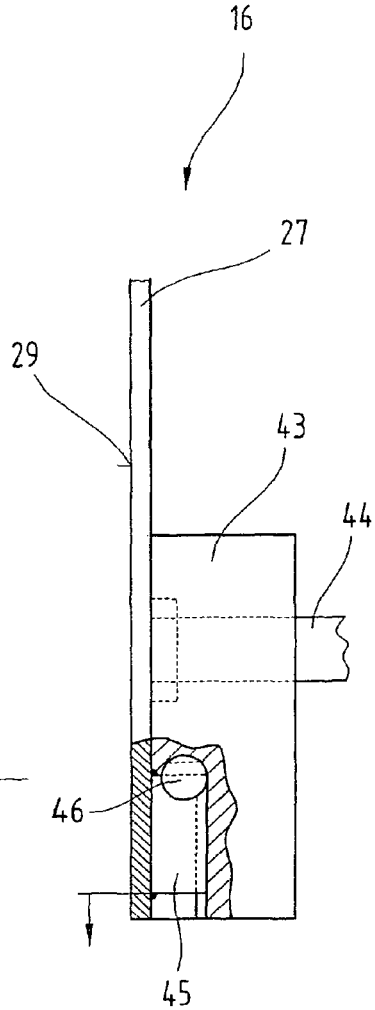
FIG. 7 is a simplified, schematic diagram in partial cross-section showing a side view of the end region of the pressing mechanism illustrated in FIG. 6.

A comparison of FIGS. 3, 6 and 7 shows one possible schematically illustrated embodiment whereby the flat section 27 of the pressing mechanism 16 can be tensed in the direction of its longitudinal extension as described above. The two support elements 42, 43 are supported on the frame parts 10, 17 so that they are stationary with the displacement mechanism 20 connected in between. This support may be provided by means of a retaining element 44 of the displacement mechanism 20, which can be used for adjusting the distance of the pressing mechanism 16 from the support plane 12 at the same time. This retaining element 44 is connected to the support element 43 to enable tensile forces to be transmitted from the flat section 27 one the one hand and to enable a height adjustment to be made to the flat face 29 or pressing surface 32 with respect to the printing medium 2 on the other hand.

At least one stop element 45 is fixedly connected to the flat section 27 in the region of its end 19 and is in turn guided in the longitudinal direction of the flat section 27 in the support element 43 by means of a longitudinal guide to enable a relative displacement of the support element 43 with respect to the flat section 27 without the support element 43 being lifted off the flat section 27 in the direction perpendicular to its longitudinal extension. This guide may be provided by various different types of guide mechanisms known from the prior art, such as a dovetail guide, a T-groove guide or similar.

The stop element 45 is provided with a positioning element 46, which may be a bolt guided in the support element 43, for example. The stop element 45 is preferably oriented in the longitudinal direction of the flat section 27, in which case the positioning element 46 is oriented at an angle, in particular normal, to it. In a contact region of the stop element 45 and the positioning element 46, the latter are preferably provided with positioning surfaces 47, 48 extending at an angle with respect to their longitudinal extension, which engage with one another in the form of a slanting plane. When the positioning element 46 is moved in relative to the support element 32, for example by means of a lever arrangement 49—see FIG. 3—as indicated by the arrow in FIG. 6—a relative movement takes place between the support element 43 supported in a stationary arrangement on the frame parts 10, 17 and the flat section 27 connected via the stop element 45. The latter is tensed when the lever arrangement 49 is operated, for example in the form of a jaw closing movement, because the flat section 27 is moved relative to the support element 43 due to the mutually engaged positioning surfaces 47, 48 and the tensing force is thus applied to the flat section 27 of the pressing mechanism 16. If an angle that will produce a retaining action by friction is selected, an additional means for fixing the position in the tensed position can be dispensed with. It should be pointed out that the tensing mechanism for the flat section 27 illustrated here is but one of many examples of embodiments which might be selected. It would also be possible to use clamping elements of any other type, such as piston-cylinder systems, spindle drives, etc.

To enable the printing medium 2 to be fed in more easily and reliably and avoid any possible damage, it is also of advantage to provide a baffle mechanism 50 or one or more baffle elements on the pressing mechanism 16, in particular the flat section 27, at the end 18 facing the feed-in region 5, as indicated on a simplified basis in FIG. 1. Here, a funnel-shaped baffle surface widening in the direction opposite the forward feed direction 7 merges without any offset into the pressing surface 32 formed on the flat section 27, such as commonly used on such systems.

The embodiments illustrated as examples represent possible design variants of the inkjet printer 1 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the inkjet printer 1, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2; 3, 4, 5; 6, 7 constitute independent solutions proposed by the invention in their own right. The objectives and associated solutions proposed by the invention may be found in the detailed descriptions of these drawings.

| List of reference numbers | |
|---|---|
| 1 | Inkjet printer |
| 2 | Medium |
| 3 | Print head arrangement |
| 4 | Print head |
| 5 | Feed-in region |
| 6 | Forward feed mechanism |
| 7 | Forward feed direction |
| 8 | Discharge region |
| 9 | Printing region |
| 10 | Frame part |
| 11 | Printing table |
| 12 | Support plane |

-continued

| List of reference numbers | |
|---|---|
| 13 | Orifice |
| 14 | Suction system |
| 15 | Conveyor belt |
| 16 | Pressing mechanism |
| 17 | Frame part |
| 18 | End |
| 19 | End |
| 20 | Displacement mechanism |
| 21 | Profiled section |
| 22 | Guide arrangement |
| 23 | Track |
| 24 | Guide carriage |
| 25 | Drive motor |
| 26 | Control unit |
| 27 | Flat section |
| 28 | Flat face |
| 29 | Flat face |
| 30 | Longitudinal side edge |
| 31 | Longitudinal side edge |
| 32 | Pressing surface |
| 33 | Transition region |
| 34 | Longitudinal guide portion |
| 35 | Shoulder |
| 36 | Thickness |
| 37 | Angled section |
| 38 | Leg |
| 39 | Recess |
| 40 | Leg surface |
| 41 | Leg |
| 42 | Support element |
| 43 | Support element |
| 44 | Retaining element |
| 45 | Stop element |
| 46 | Positioning element |
| 47 | Positioning surface |
| 48 | Positioning surface |
| 49 | Lever arrangement |
| 50 | Baffle mechanism |

The invention claimed is:

1. Inkjet printer (1) for printing different media (2), with a print head arrangement (3) comprising at least one print head (4) for printing the medium (2) and with a printing table (11) constituting a support plane (12) for supporting the printing medium (2), and orifices (13) of a suction system (14) are provided in the support plane (12) in at least certain regions for retaining the printing medium (2) during the printing operation, as well as a forward feed mechanism (6) for the printing medium (2), and the forward feed mechanism (6) is provided in the form of at least one endlessly circulating conveyor belt (15), and in the region of the printing table (11), at least one pressing mechanism (16) is provided for the printing medium (2), at least in the region of a side edge oriented in the forward feed direction (7), with a pressing force which acts in the direction perpendicular to the support plane (12), wherein the pressing mechanism (16) is disposed in at least a printing region (9) of the print head arrangement (3) and is essentially provided in the form of a flat section (27) with flat faces (28, 29) and longitudinal side edges (30, 31) extending in between, and the pressing mechanism (16) is retained respectively at its ends (18, 19) spaced apart from one another in the forward feed direction (7) on a respective frame part (10, 17) of the printer (1) disposed at a distance apart in the forward feed direction (7) and oriented transversely to the forward feed direction (7), in particular perpendicular thereto, and disposed at a distance apart from the support plane (12) in the direction perpendicular to the support plane (12).

2. Inkjet printer (1) according to claim 1, wherein the pressing mechanism (16) is displaceable relative to the printing table (11) in a direction perpendicular to the side edge and parallel with the support plane (12).

3. Inkjet printer (1) according to claim 1, wherein the pressing mechanism (16) is displaceable relative to the support plane (12) in a direction perpendicular to the support plane (12).

4. Inkjet printer (1) according to claim 1, wherein a pressing mechanism (16) is provided for each of the two side edges.

5. Inkjet printer (1) according to claim 1, wherein the first pressing mechanism (16) is mounted on the frame part (10, 17) so as to be stationary with respect to the forward feed direction (7) and the other pressing mechanism (16) is mounted on the frame part (10, 17) so that it can be moved transversely to the forward feed direction (7), in particular perpendicular thereto.

6. Inkjet printer (1) according to claim 1, wherein the pressing mechanism (16) is provided with at least one displacement mechanism (20) for effecting the displacement perpendicular to the side edge and parallel with the support plane (12).

7. Inkjet printer (1) according to claim 6, wherein the displacement mechanism (20) has at least one drive motor (35).

8. Inkjet printer (1) according to claim 6, wherein the displacement mechanism (20) is electrically connected to a control unit (26).

9. Inkjet printer (1) according to claim 1, wherein at least one sensor is provided in a feed-in region (5) of the printing table (11) oriented in the forward feed direction for detecting the side edge of the printing medium (2) and the sensor is electrically connected to the control unit (26).

10. Inkjet printer (1) according to claim 1, wherein the pressing mechanism (16) extends by only a minimum across a printing plane formed by the printing medium (2) towards the side remote from the support plane (12).

11. Inkjet printer (1) according to claim 1, wherein in the region of a first longitudinal side edge (30), the flat section (27) has a pressing surface (32), offset from the flat face (29) directed towards the support plane (12), extending in the direction towards the oppositely lying flat face (28) which extends from the first longitudinal side edge (30) in the direction towards the other longitudinal side edge (31).

12. Inkjet printer (1) according to claim 11, wherein a transition region (33) between the pressing surface (32) and the flat face (29) of the flat section (27) directed towards the support plane (12) forms a longitudinal guide portion (34) for the printing medium (2).

13. Inkjet printer (1) according to claim 1, wherein the flat face (29) of the flat section (27) directed towards the support plane (12) is disposed directly adjacent to or adjoining the latter.

14. Inkjet printer (1) according to claim 1, wherein the flat section (27) has a web-type shoulder (35) on the other longitudinal side edge (31), the thickness (36) of which in the direction perpendicular to its longitudinal extension is slimmer than a thickness of the flat section (27) in the same spatial direction.

15. Inkjet printer (1) according to claim 14, wherein an angled section (37) is retained on the web-type shoulder (35).

16. Inkjet printer (1) according to claim 15, wherein a first leg (38) of the angled section (37) has a groove-shaped recess (39) for accommodating the web-type shoulder (35).

17. Inkjet printer (1) according to claim 15, wherein a leg surface (40) of the first leg (38) of the angled section (37) is virtually flush with the flat face (28) of the flat section (27) facing away from the support plane (12).

18. Inkjet printer (1) according to claim 15, wherein another leg (41) of the angled section (37) is oriented in the direction towards the support surface (12).

19. Inkjet printer (1) according to claim 1, wherein the pressing mechanism (16) formed by the flat section (27) is retained so that it is tense in its longitudinal extension between the frame parts (10, 17) spaced apart in the forward feed direction (7).

20. Inkjet printer (1) according to claim 1, wherein a respective support element (42, 43) is provided on the flat section (27) at the ends (18, 19) facing away from one another and these are supported on the frame parts (10, 17) disposed at a distance apart from one another in the forward feed direction (7).

21. Inkjet printer (1) according to claim 1, wherein at least one baffle mechanism (50) is provided on the pressing mechanism (16) at least at the end (18) facing a feed-in region (5).

22. Inkjet printer (1) according to claim 1, wherein the forward feed mechanism (6) co-operates with the printing table (11).

* * * * *

UNITED STATES PATENT AND TRADEMARK OFFICE

CERTIFICATE OF CORRECTION

PATENT NO. : 8,292,420 B2
APPLICATION NO. : 11/920947
DATED : October 23, 2012
INVENTOR(S) : Weingartner et al.

It is certified that error appears in the above-identified patent and that said Letters Patent is hereby corrected as shown below:

In particular, on the cover page, Column 1, Item [86] please change the § 371 (c)(1), (2), (4) Date from "Jul. 31, 2008" to correctly read: -- Jul. 31, 2009 --.

On the cover page, Column 1, Item [30] please insert the Foreign Application Priority data to correctly read as follows: -- May 25, 2005..... AT 895/2005. --.

Signed and Sealed this
First Day of January, 2013

David J. Kappos

David J. Kappos
*Director of the United States Patent and Trademark Office*